US007992797B2

(12) United States Patent
Reichle

(10) Patent No.: US 7,992,797 B2
(45) Date of Patent: Aug. 9, 2011

(54) RAILROAD SIGNAL LINE ATTACHMENT CLIP

(75) Inventor: David L. Reichle, Bradenton, FL (US)

(73) Assignee: Fastrax Industries, Inc., Littleton, CO (US)

( * ) Notice: Subject to any disclaimer, the term of this patent is extended or adjusted under 35 U.S.C. 154(b) by 567 days.

(21) Appl. No.: 11/862,676

(22) Filed: Sep. 27, 2007

(65) Prior Publication Data

US 2008/0257973 A1 Oct. 23, 2008

Related U.S. Application Data

(60) Provisional application No. 60/912,595, filed on Apr. 18, 2007.

(51) Int. Cl.
*E01B 9/00* (2006.01)
*E01B 13/00* (2006.01)

(52) U.S. Cl. ..... 238/316; 238/338; 238/351

(58) Field of Classification Search ..... 238/310, 238/312–316, 338, 343, 351, 352, 355
See application file for complete search history.

(56) References Cited

U.S. PATENT DOCUMENTS

| | | | | |
|---|---|---|---|---|
| 2,529,153 | A * | 11/1950 | Hain | 238/14.14 |
| 2,875,969 | A | 3/1959 | Thomson | |
| 2,886,088 | A | 5/1959 | Brancato | |
| 2,910,567 | A | 10/1959 | Holstein | |
| 3,233,097 | A | 2/1966 | Watkins | |
| 3,243,573 | A | 3/1966 | Weisse et al. | |
| 3,264,472 | A | 8/1966 | Simmons | |
| 3,349,722 | A | 10/1967 | Davis | |
| 3,394,251 | A | 7/1968 | King et al. | |
| 3,439,161 | A | 4/1969 | McElwee et al. | |
| 3,697,746 | A | 10/1972 | Patterson et al. | |
| 3,830,427 | A | 8/1974 | Polidori | |
| 4,195,805 | A | 4/1980 | Keep, Jr. | |
| RE31,081 | E | 11/1982 | Keep, Jr. | |
| 4,391,425 | A | 7/1983 | Keep, Jr. | |
| 4,671,475 | A | 6/1987 | Widmer | |
| 5,004,190 | A | 4/1991 | Montierth et al. | |
| 5,288,016 | A * | 2/1994 | Owen | 238/355 |
| 5,824,997 | A | 10/1998 | Reichle et al. | |
| 6,104,010 | A | 8/2000 | Reichle et al. | |
| 6,213,407 | B1 * | 4/2001 | Ellis et al. | 238/310 |
| 2006/0032934 | A1 | 2/2006 | Reichle | |
| 2006/0150563 | A1 | 7/2006 | Naheem | |

* cited by examiner

*Primary Examiner* — S. Joseph Morano
*Assistant Examiner* — R. J. McCarry, Jr.
(74) *Attorney, Agent, or Firm* — Marsh Fischmann & Breyfogle LLP

(57) ABSTRACT

The present disclosure relates to a system and method for non-invasively attaching components to railroad track rails. More specifically, an anchor is provided that securely fastens to the track rail in a non-invasive manner for holding one or more signal lines to a surface of the track rail. In one embodiment, the non-invasive anchor utilizes a compressive force to clamp to a flange portion of the track rail. In this regard, first and second body members of the anchor may be advanced toward the toward opposing surfaces of track rail to compress the component between a portion of the anchor and a surface of the track rail. In one embodiment, a pawl prevents the withdrawal of these body members from one another such that the compressive force may be maintained once the anchor is applied to the track rail.

14 Claims, 7 Drawing Sheets

RAILROAD SIGNAL LINE ATTACHMENT CLIP

CROSS-REFERENCE

This application claims the benefit of U.S. Provisional Application No. 60/912,595 having a filing date of Apr. 18, 2007, the entire contents of which are incorporated herein by reference.

FIELD OF THE INVENTION

The present invention relates to a non-invasive system and method for forming an electrical connection between a railroad track rail and any electrical conductor, for example signal lines, wires or cables.

BACKGROUND OF THE INVENTION

In typical railroad systems, a length of many miles of track may be divided into a plurality of successive adjacent blocks that may be further subdivided into cut circuits (collectively track sections) for control, monitoring, heating and/or maintenance purposes. Each track section forms a track circuit wherein the track rails are utilized to carry electrical signals. In some cases, the track rails in each track section are electrically insulated from the track rails of adjacent track sections such that each circuit may be utilized individually for control and monitoring purposes.

Monitoring the track circuits provide means for detecting the presence or absence of a railroad vehicle, equipment and/or any other foreign apparatus that activates or otherwise interacts with a given track section. Information obtained from such monitoring may be used for traffic control purposes thereby allowing trains to operate at safe speeds and/or to identify train locations as the trains pass from one-track section to another. For instance, it is customary to detect the presence of a railroad vehicle in a particular track section by detecting the presence of a short circuit or other variation in a signal being monitored through the rails of the track section. For instance, when a railroad vehicle enters a particular track section, the wheels and axle of the vehicle provide a short circuit between the rails of that track section or otherwise alter the track circuit in the track section (e.g., produce a change in impedance). Based upon detection of such a short circuit or signal variation, one or more control signals may be generated to operate, for example, track switches, railroad crossing gates, communications systems, maintenance equipment, etc. The track rails, in addition to carrying signals utilized for train detection and control, may also carry other signals (e.g. at different frequencies). Such signals may include, without limitation, train-to-wayside, wayside-to-train and train-to-train communications.

Irrespective of the type or purpose of the signals passing through the track sections, it is generally necessary to electrically interconnect one or more electrical conductors, wires or cables (hereafter signal lines) to the track rail to provide, receive and/or transfer such signals.

SUMMARY OF THE INVENTION

One objective of the present invention is to provide an improved system and method for electrically coupling an electrical conductor (e.g., a signal line) to a track rail.

Another objective of the present invention is to provide an anchor for holding components relative to the rail without penetrating the rail. This includes holding components relative to the rail and/or in direct contact with the rail.

Another objective of the present invention is to provide an anchor for holding components relative to the rail without that may be quickly and securely attached to the rail.

The inventor of the present invention has recognized that current invasive anchoring techniques for securing components to a track rail may provide certain challenges during application in the field. Specifically, many anchoring techniques require drilling or welding to a track rail. Such techniques are typically labor intensive. Further if drilling or welding is not correctly perfumed, the structural integrity of a rail may be damaged. Accordingly, the inventor has recognized it would be desirable to avoid the use of welding or bolting to electrically interconnect electrical signal conductors (e.g., signal lines) to track rails. Likewise, it has been determined that passive/non-intrusive anchoring techniques that allow for quickly and correctly positioning a component relative to the track rail are desirable.

Accordingly systems and methods (i.e. utilities) for directly contacting a signal conductor to a surface of a track rail is provided that further incorporates the use of a mechanical anchor or clamp to maintain a signal conductor (or other electrical conductor) in a fixed positional relationship with a railroad track component. The utilities may include preparing a contact area of a railroad track component, attaching a mechanical anchor to the railroad track component and compressing an electrically conductive portion of a signal conductor between a portion of the anchor and the track rail. An adhesive may be applied to the contact area an/or the signal conductor. For instance, such an adhesive may be applied to cover exposed surfaces of the signal conductor and/or a prepared surface of the track rail. Such an adhesive may prevent corrosion at or around the contact area.

According to a first aspect, an anchor is provided for use in connecting a component to a track rail. The anchor includes a first body member having a first rail contact surface for engaging a first rail surface. The anchor also includes a second body member having a second rail contact surface for engaging a second rail surface. The first and second body members are moveably connected. In this regard, the first and second body members may be moved relative to one another to compress a portion of a rail therebetween. A pawl is attached to one of the body members and is adapted to engage the engagement surface of the body member. Such a pawl may permit movement between the body members in substantially a single direction. That is, while some movement may be permitted between the body members, the pawl will generally prevent unintended withdrawal of one of the body members relative to the other body member such that a compressive force may be maintained between opposing surfaces of the track rail.

As will be appreciated, one or both of the rail contact surfaces may be sized and/or shaped to receive a portion of the rail. For instance, such surfaces may be adapted to receive a flanged edge of the foot of a track rail. A component, such as a signal line, may be disposed between the contact surface of one or both of the body members and the track rail. Accordingly, when the body members are compressed together, the signal line may be compressed against the surface of the track rail.

In one arrangement, the first and second body members are slidably connected. In such an arrangement, one of the body members may be at least partially disposed within the other body member. In such an arrangement, a receiving body member may include a channel for receiving a portion of the other body member.

The pawl may be any element that is adapted to engage a surface while permitting movement in one direction and limiting movement in another direction. In one arrangement, the pawl is a spring member attached to one of the body members and which is adapted to engage a surface on the other body member. In one embodiment, this spring member has a hardness that is greater than the hardness of the engagement surface. This may allow the spring member to bite into that surface. In a further arrangement, the engagement surface includes a plurality of spaced notches or recesses that may be selectively engaged by the pawl.

According to another aspect, a method is provided for engaging a signal wire with the track rail. The method includes placing a portion of a track rail between first and second contact surfaces of a rail anchor. A signal wire may then be placed between the surface of the track rail and one of the contact surfaces of the anchor. At this time, a first portion of the rail anchor may be advanced towards the second portion of the rail anchor such that the first and second contact surfaces are compressed together. In this regard, the signal wire may be compressed against a surface of the track rail. In conjunction with such advancement, a pawl associated with one portion of the rail anchor engages an engagement surface of the other portion of the rail anchor to prevent withdrawal of these portion relative to one another. In this regard, upon being advanced relative to one another, the first and second portions may maintain a compressive force therebetween.

In one arrangement, placing a track rail may include placing outside edges of the foot or flanges of the track rail between the first and second contact surfaces. In another arrangement, advancing may include compressing the first and second portions of the track rail between a clamp. In such an arrangement, a clamp may be utilized to advance the first portion towards the second portion. Further, such a clamp may be removed after the first and second portions are advanced to a desired position.

In another arrangement, placing a track rail may include placing the head of the track rail between the contact surfaces. In such an arrangement, the signal wire may be pressed against an outside edge of the head of the rail. In a further arrangement, the signal wire may be bonded thereto and the rail anchor may extent over the top of the rail head. In this regard, the anchor may 'wear away,'. However, the anchor may remain in place long enough for a bonding agent used to bond the signal wire to the rail head to cure.

The method may further include cleaning a surface of the track rail, for instance, the surface to which the signal wire and/or a contact surface of the anchor may be applied. Such cleaning/preparation may allow for improving electrical contact between the track rail and the signal line. For instance, such preparation may entail the removal of, for example, rust and/or other surface imperfections/oxidations. Such preparation may be performed by chemically treating or abrading the surface of the track rail. Further, the prepared area may then be cleansed (for example, utilizing alcohol, etc.) to remove any remaining particulates. In a further arrangement, an adhesive may be applied over a portion of a contact area between the signal wire and the track rail. Such adhesive application may include encapsulating all or a portion of one of the contact surfaces of the anchor. In a further arrangement, electrically conductive tapes may be applied to the surface of the track rail and/or the electrically conductive portion of a signal line. Such electrically conductive tapes may provide improved electrical conductivity therebetween.

BRIEF DESCRIPTION OF THE DRAWINGS

For a more complete understanding of the present invention and further advantages thereof, reference is now made to the following Detailed Description taken in conjunction with the drawings in which.

DETAILED DESCRIPTION

The present invention is directed to the use of an adjustable rail clamp to connect a signal conductor to a railroad track rail. It will be appreciated that the invention is applicable to the electrical interconnection of any electrical conductor to a track rail for any purpose.

Figure 1:
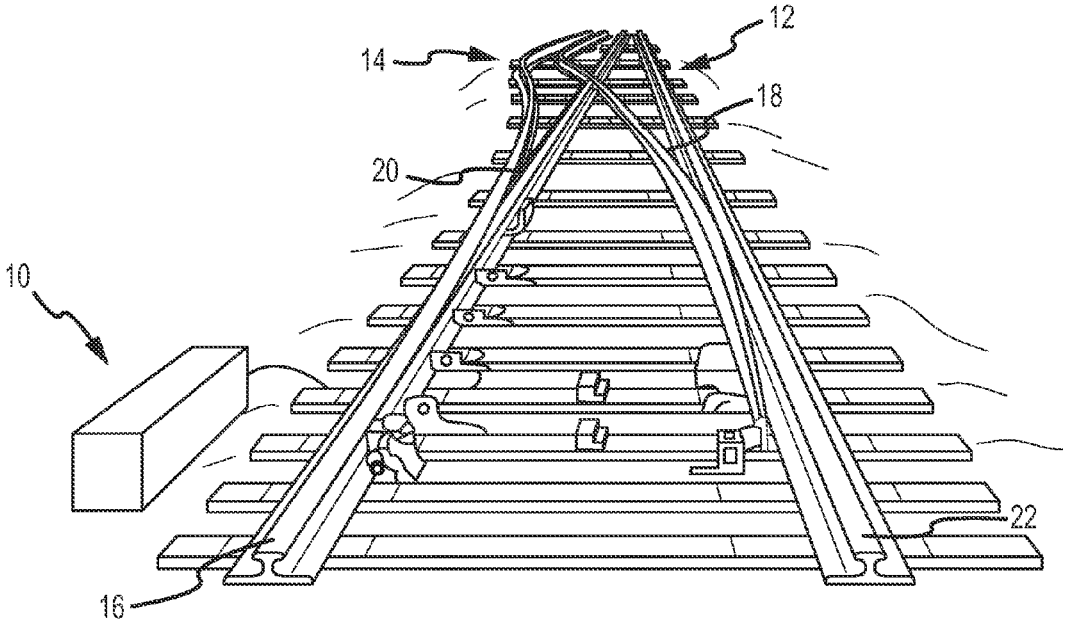
FIG. 1 shows a section of railroad track rails.

Referring to FIG. 1, a section of railroad track is generally identified by the reference numeral 10. As shown, the section of railroad track 10 includes a switching mechanism to switch trains between first and second tracks 12, 14. Each set of tracks 12, 14 includes two of track rails. As shown, the first track 12 includes a switching rail 12*a* and a stationary or stock rail 12*b* (also known as a running rail). Likewise, the second track 14 includes a stock rail 14*a* and a switching rail 14*b*. For purposes of controlling traffic, each track rail 12, 14 is electrically interconnected to a signal providing and monitoring system 8 that is located in proximity to the rail connection location.

The signal providing and monitoring system 8 is operative to redirect trains from the first track 12 to the second track 14 by mechanically moving the switching rails 12*a* and 14*b* relative to the stock rails 12*b* and 14*a*, respectively. Generally, a switch mechanism is mechanically interconnected to the switching rails 12*a* and 14*b* in order to move them in unison relative to the stock rails 12*b* and 14*a* at the connection point. The switching mechanism is typically attached to the rails with an electrically isolated linkage. In the case of switching rail 14*b*, mechanical movement may occur on both ends. That is, a first end of the switching rail 14*b* may be moved relative to the stock rail 12*b* and a second end of the switching rail 14*b* may be moved relative to a distal portion of switching rail 12*a*, where these rails cross. This point is sometimes referred to as a railroad "frog" 15. The frog 15 may in some instances be a passive spring actuated system that utilizes the pressure from the wheels of a passing railroad vehicle to permit railroad vehicle wheels to access the correct track. Alternatively, the frog 15 may be mechanically actuated/moved to permit railroad vehicle wheels to access the correct track. To effectuate switching of the switching rails and/or the railroad frog, the monitoring system 8 may detect the presence of approaching railroad vehicles and/or receive signals from approaching vehicles.

In a common arrangement, the signal providing and monitoring system 8 utilizes the track rails 12*a*, 12*b* and 14*a*, 14*b* to detect the presence and, generally, the speed of approaching railroad vehicles and/or to receive signals from the approaching railroad vehicles. In this regard, each set of track rails 12, 14 form an electric circuit (i.e., track circuit) that is interconnected to the monitoring system 8 by one or more signal lines 16. In one arrangement, a resulting electrical circuit may be short circuited when the wheels and axle of an approaching railroad vehicle interconnects the track rails 12*a*, 12*b* or 14*a*, 14*b*. In another arrangement, the impedance of a signal changes due to the presence of an approaching railroad vehicle. The length of each track circuit depends upon various circumstances including the distance over which signals may be effectively sent, received and/or detected. Normally, such a track circuit will fall into the range of several feet to a few miles. To define such track circuits, the track rails may be divided into adjacent sections by providing insulated joints. Such insulated joints allow for electrically isolating adjacent sections to track rail from one another.

Electrically interconnecting any device to a track rail and/or connecting adjacent track rails generally requires interconnecting an electrical conductor (hereafter signal line) to the structure of a given track rail 12, 14. Previously this has typically entailed bolting a conductor to the track rail. Such a bolting method can result in galvanic action between dissimilar metals (e.g., steel and copper), which may also results in increased resistance over time. Such resistance may be a limiting factor in the length of the tack circuits and/or may result in ineffective signal transfer. Further, bolting requires penetrating the surface of the rail, which can structurally weaken a rail not carefully located. Accordingly, the present invention is directed to electrically interconnecting a signal line 16 to surface of the track rail utilizing a non-invasive clamp.

Figure 2:
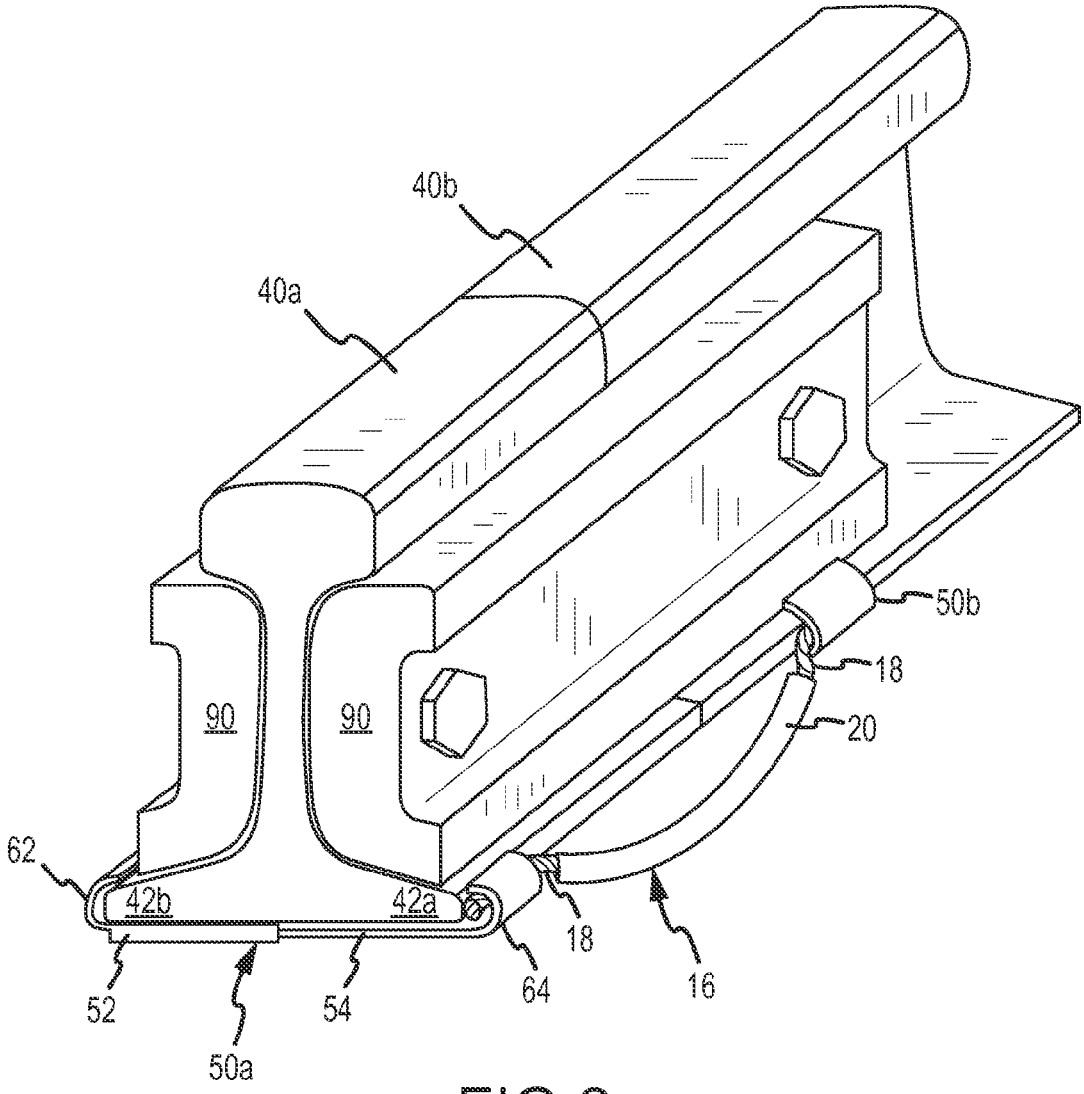
FIG. 2 shows a perspective cross sectional view of an interconnection between a track rail and a signal conductor.

FIG. 2 shows a cross-sectional/perspective view of one application of the present invention wherein a signal line 16 is contacted to a surface of a track rail 40 to make electrical contact therewith. More specifically, the signal line 16 is contacted to the outside edge surface of the flange 42A of the track rail 40 utilizing an adjustable anchor 50. As will be appreciated, the signal line 16 will typically include an electrically conductive core 18 (e.g., braided copper wire) and a nonconductive coating 20 or sheath. In order to conductively couple the signal line 16 with the track rail 40 a portion of the nonconductive coating 20 is removed from the signal line 16 to expose a portion of the electrically conductive core 18. The anchor 50 is then utilized to compress the exposed conductive core 18 against the surface of the track rail 40 to form an electrical connection. As shown, the anchor 50 includes first and second members 52, 54 for engaging opposing outside edge surfaces of the flanges 42A, 42B of the track rail 40. Each member 52,54 of the anchor includes a U-shaped end portion 62, 64, respectively (e.g., hook end) for engaging around one of the flanges 42*a*, 42*b*. The U-shaped end portions 62, 64 of the body members 52,54 may be sized to extend over and partially around an outside edge of a flange of a track rail. The opposite ends of these members 52, 54 are connected beneath the bottom surface of the track rail 40. As will be discussed herein, these members 52, 54 may be compressed together to apply and maintain a compressive force between their U-shaped end portions 62, 64.

FIG. 2 also illustrates one application where it is desirable to interface a signal line 16 with a track rail 40. Specifically, at the junction between a first track rail 40A and a second track rail 40B, it may be desirable to electrically interconnect these rails 40A, 40B as near as possible to the junction. In this regard, it is noted that signals may be sent through the rails to determine if the rails are intact. Accordingly, if the signal line 16 interconnects first and second rails 40A, 40B at a large spacing (e.g., several feet), damage to the rails 40A, 40B between the interconnection points of the signal line 16 may not be identified. Further complicating signal line connection near a rail junction is that fact that at the location of a rail junction splice bars 90 are typically bolted to one or both sides of the webs of the abutting track rails 40A, 40B. This typically prevents attaching signal lines to the track rails 40A, 40B on the top surface of the flanges/foot and/or to the web of the track rails. Accordingly, the non-invasive anchor 50 provided herein allows for quickly and conveniently interconnecting a signal line 16 to an outside edge of a flange 42 of a track rail. Further it will be appreciated that as the anchors 50A, 50B attach below a track rail and hold a signal line to the outside edge of the flange 42A, the distance between these anchors 50A, 50B may be minimal (e.g., a few inches). Such an anchor may also be utilized to provide temporary connections where, for example, short term repairs (e.g., in the middle of the night) are made to a track rail.

Figure 3:
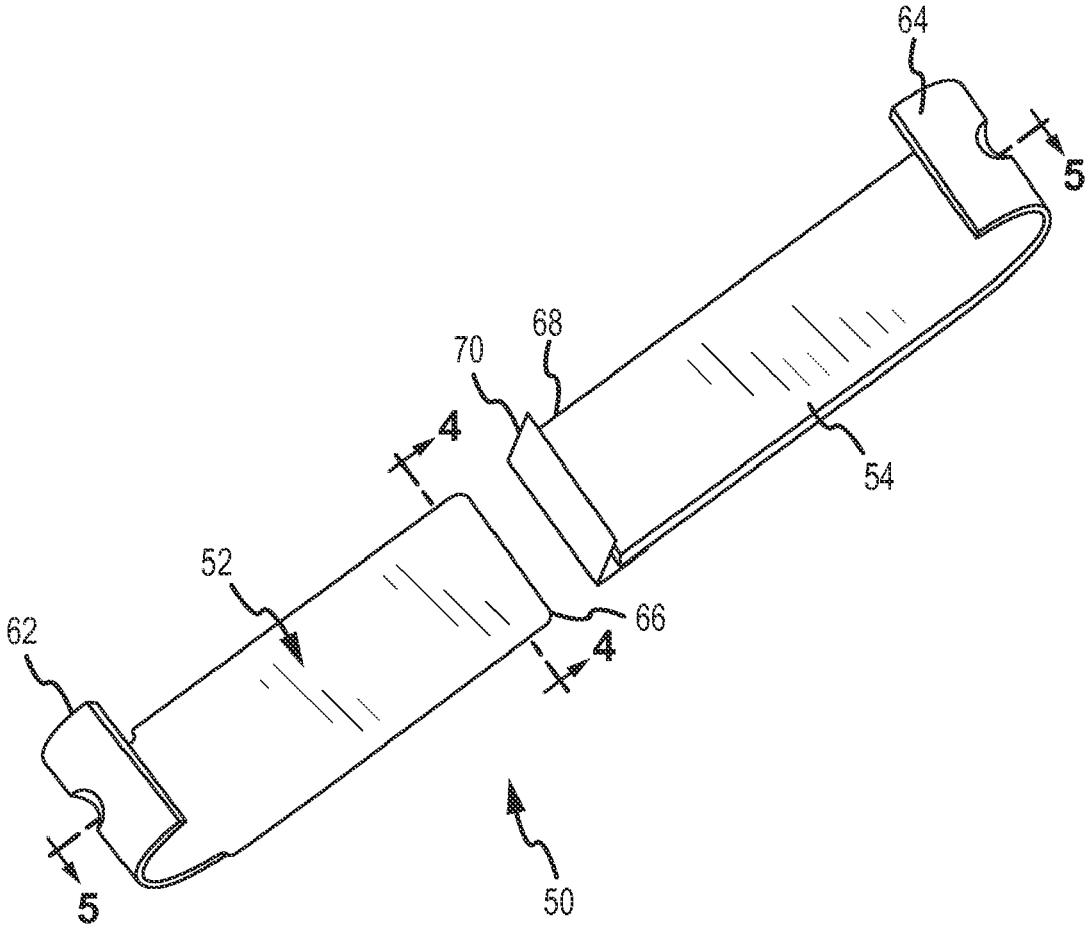
FIG. 3 shows a perspective view of one embodiment of a railroad anchor.
Figure 4:
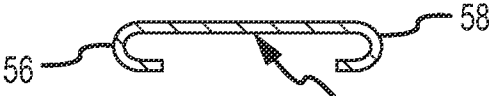
FIG. 4 shows an end view of a portion of the anchor of FIG. 3.

FIGS. 3-7 illustrate embodiments of an adjustable anchor 50 corresponding to the anchors 50A, 50B illustrated in FIG. 2. As shown in FIG. 3, the anchor 50 includes first and second members 52, 54 that are adapted for slideable engagement. To permit such slideable engagement, the first body member 52 includes a receiving end 66 that receives a mating/insertion end 68 of the second body member 54. In the present embodiment, the receiving end 66 of the first body member 52 defines a channel, as illustrated in FIG. 4. The channel is sized to receive the insertion end 58 end portion of the second member 54. In this regard, inside lateral edges 56, 58 of the channel may be slightly wider than the outside edges of the second member 54. In the present embodiment, the surface between the first and second lateral edges 56, 58 of the channel end of the first member 52 defines an engagement surface 60. This engagement surface 60 is designed to be engaged by a barb or pawl 70 located near the insertion end 68 of the second member 54.

Figure 5:
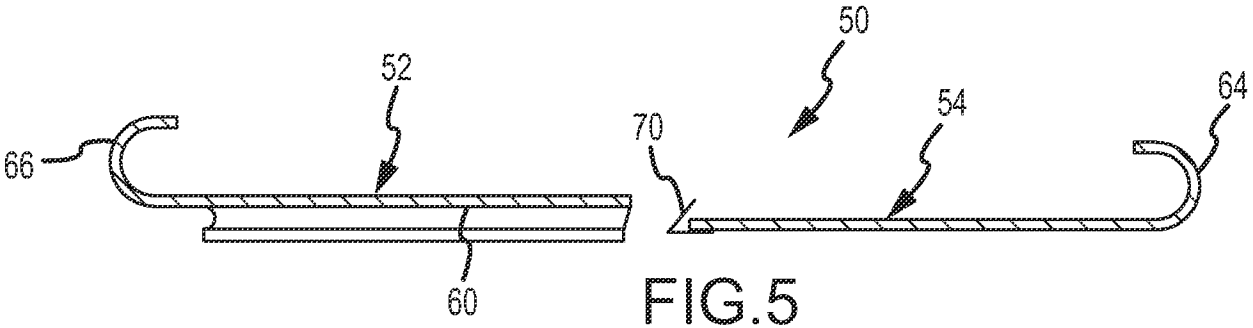
FIG. 5 shows a cross-sectional side view the components of the anchor of FIG. 3 prior to engagement.

The pawl 70 is adapted, upon insertion (e.g., FIG. 6), to engage the engagement surface 60 of the first body member 52 to prevent unintended withdrawal/removal of the second body member 54 from the first body member 52. As shown in FIG. 5, the pawl 70 is a L-shaped element having an acute inside angle between the legs of the L-shaped element. One leg of the L-shaped element is fixedly interconnected to the insertion end 68 of the second body member 54. When the second body member 54 is disposed within the channel defined by the receiving end 66 of the first body member 52, the free leg of the pawl 70 is compressed such that its free edge rides upon the and is pressed against the engagement surface 60. See FIG. 6.

In the present embodiment, the pawl 70 is formed of a spring steel that has a hardness that is greater than the hardness of the engagement surface 60. Accordingly, the pawl 70 is able to bite into the engagement surface. The ability of the pawl 70 to bite into the engagement surface 70 in combination with its angled shape prevents retraction of the second body member 54 from the first body member 52. In this regard, the anchor 50 is a unidirectional device that allows the first and second body members to be compressed together while preventing their withdrawal from one another. However, it will be appreciated that the first and second body members may be released by inserting a release element (e.g., thin metal strap) from the rearward end of the channel such that the release element is disposed between the free edge of the pawl 70 and the engagement surface 60. However, when applied to a track rail 40, the anchor is designed to be resistant to removal.

Figure 6:
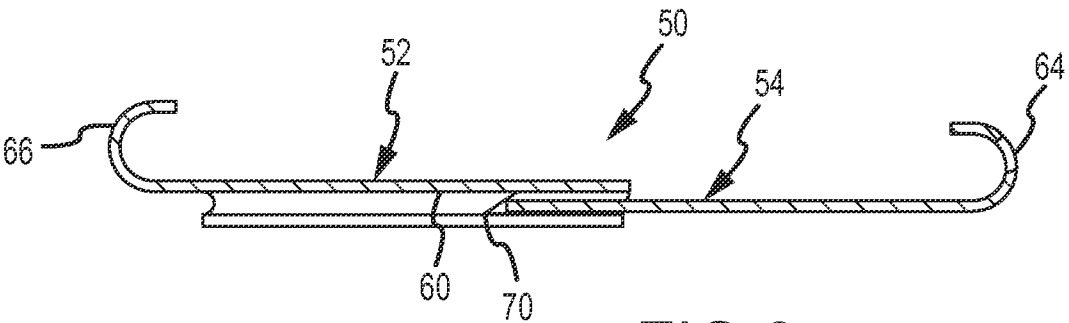
FIG. 6 shows a cross-sectional side view the components of the anchor of FIG. 3 as engaged.
Figure 7:
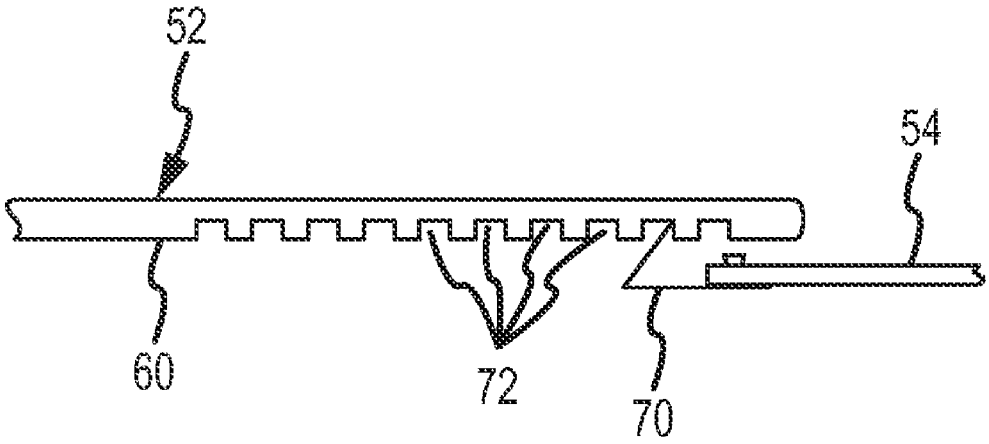
FIG. 7 shows a pawl and notch arrangement that may be utilized with the anchor of FIG. 3.

Though illustrated above as utilizing a pawl 70 having a continuous engagement edge that has a hardness that is greater than the hardness of engagement surface 60, it will be appreciated that other arrangements may be utilized. For instance, the free edge of the pawl 70 may be serrated to improve its engagement with the engagement surface 60. FIG. 6 illustrates an alternate engagement surface 60 that includes a plurality of spaced notches 72 which the free edge of the pawl 70 may engage. It will be appreciated that any mechanism that allows for maintaining the fixed position of the first and second body members relative to one another may be utilized. However, it will be noted that the use of the pawl 70 and the smooth engagement surface as illustrated in FIGS. 4, 5 and 6 permits near continuous adjustment between the first and second body members 52, 54. In this regard, the lack of predefined pawl stops/notches may allow for finer advancement of the body members 52, 54.

Figure 8:
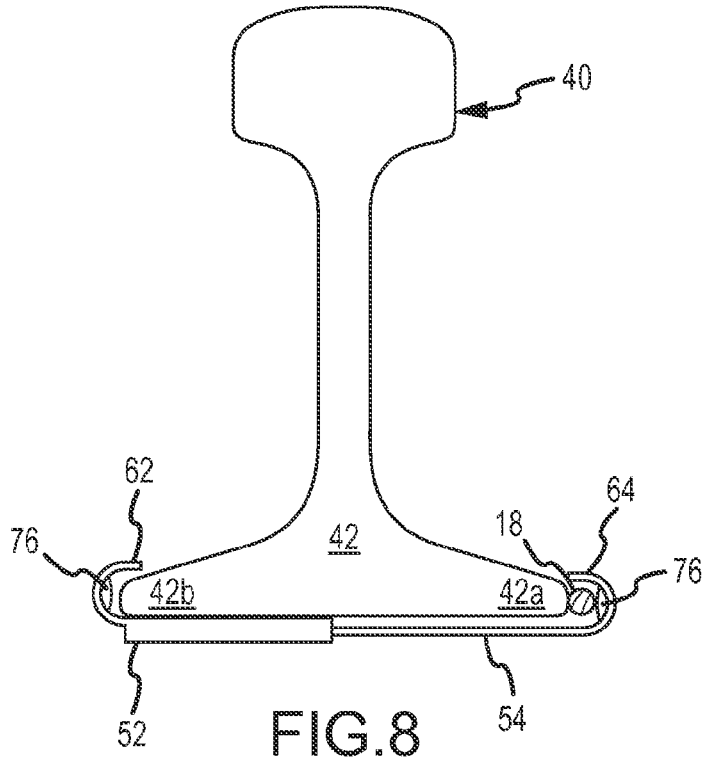
FIGS. 8-10 illustrate a process for applying the anchor of FIG. 3 to a track rail.
Figure 9:
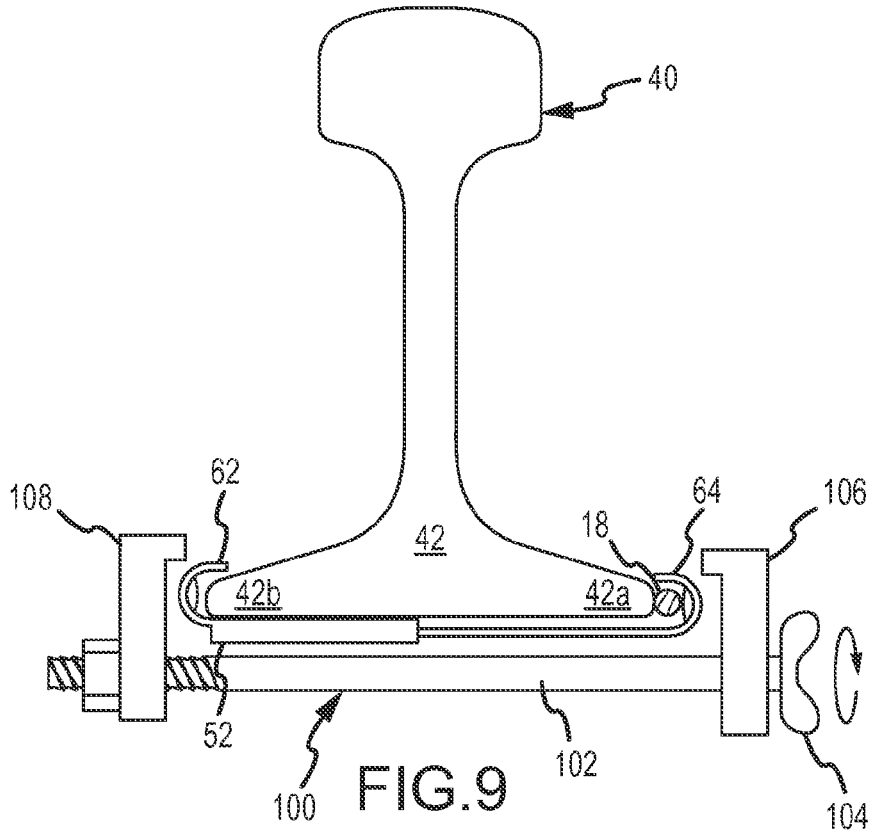
Figure 10:
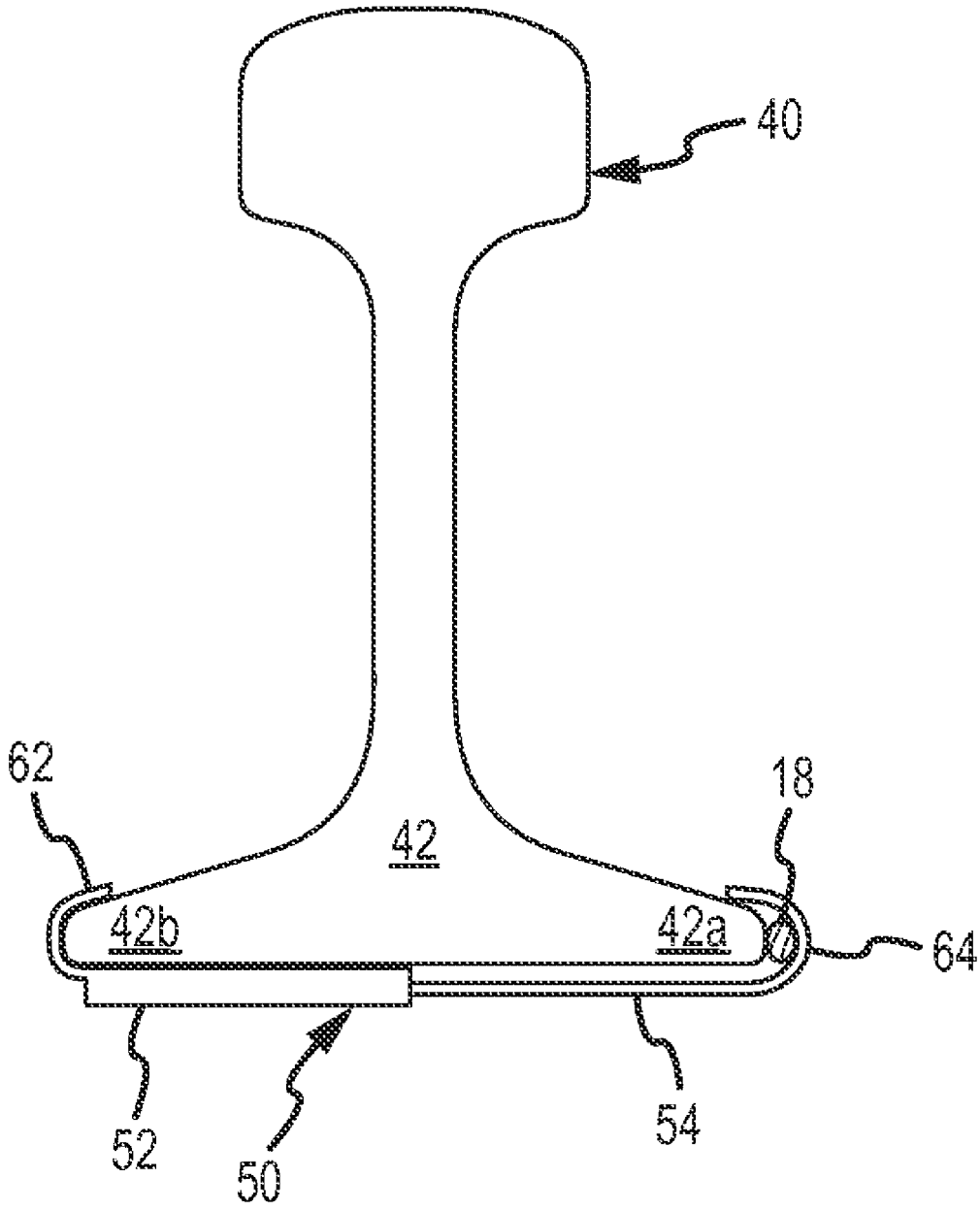

FIGS. 8, 9 and 10 illustrate the application of the anchor 50 to the foot 42 of a track rail 40. Initially, the first and second body members 52, 54 may be engaged. That is, the insertion end of the second body member 54 may be disposed within the receiving end of the first body member 52. Preferably, the distance between the U-shaped end portions 62, 64 will be greater than the width of the track rail 40 as measured between the outside edges of the opposing flanges 42*a*, 42*b* such that the track rail may be positioned between the end portions 62, 64. Alternatively, the first and second body members 52, 54 may be disposed on opposing outside surfaces 42A, 42B and the insertion end of the second body member 54 may be inserted into the receiving end 66 of the first body member 52. In any case, it is desirable that at least one of the U-shaped end portions 62, 64 be spaced far enough from the corresponding outside edge surface 42A, 42B of the flange 42 such that the exposed core 18 of a signal line 16 may be disposed between the U-shaped end portion and the track rail 40.

Once so disposed, the first and second body members 52, 54 may be advanced towards one another in order to compress the core 18 of the signal line 16 against the surface of the track rail (e.g., specifically the outside edge surface 42A of the track rail 40). In one arrangement, such advancement may be performed by hand. However, to better compress the exposed core 18 of the signal line 16 against the outside edge of the track rail 42A, it may be desirable to utilize a tightening clamp 100. See FIG. 9. In this regard, the clamp 100 may include first and second shackles or brackets 106, 108 adapted to engage the outside ends of the first and second body members 52, 54 and apply a compressive force therebetween. In the present embodiment, the clamp assembly 100 utilizes a threaded adjuster 102 that may be tightened by turning a knob or handle 104. In this regard, the threaded adjuster 102 may draw the first and second brackets 106, 108 together and thereby compress the first and second body members 52, 54 together.

Once adequately compressed, the clamp assembly 100 may be removed. At such time, the anchor 50 may be conformably fitted to the outside edges 42A, 42B of the foot 42 of the track rail 40. See FIG. 9. As shown, this may provide significant compression of the signal line core 18 against the outside surface 42A of the track rail 40. Further, when so compressed, the pawl 70 may prevent the withdrawal of the second body member from the first body member 52 and thereby prevent loosening of the anchor 50.

To further improve the compression of the signal line core 18 against the surface of the track rail, the inside surface of one or both U-shaped end portions 62, 64 of the body members 52, 54 may include a projection 76 that extends above a portion of the inside surface. See FIG. 8. This projection 76 may extend across only a portion of the width of the end-portions. The projection 76 may allow for applying an enhanced force between a portion of the signal wire core 18 and track rail.

To enhance electrical conduct between the core 18 of the signal line 16 and the track rail 40, the surface of the track rail 40 may be prepared prior to compression contact. This preparation may entail the removal of, for example, rust, oxidation, factory surface coatings and/or other imperfections on the track rail surface. Such preparation may entail chemically treating, or abrading the surface of the track rail 40. Preferably, such abrasion does not affect the structural integrity of the track rail 40 and may utilize sand paper, emory paper, steel wool and/or other abrasion techniques.

To enhance electrical conduct between the core 18 of the signal line 16 and the track rail 40, electrically conductive materials may be applied to one or both components prior to the compression of the core 18 against the track rail. For instance, electrically conductive greases or adhesives may be applied. In one arrangement, an electrically conductive tape may be applied around the core and over the contact surface of the rail. Such an electrically conductive tape may include highly conductive carbon fibers.

To help isolate the contact area and/or improve the retention of the anchor to the rail, an adhesive may be applied over the conductive core 18, the track surface and/or over the U-shaped end-portion of the anchor 50. That is, adhesive may be applied to the conductive core 18 and track rail 40 after the signal line 16 is clamped to the surface of the track rail. An electrically conductive adhesive may provide enhanced electrical contact between the track rail 40 and the core 18 of the signal line 16. In any case, the adhesive may encapsulate the exposed core of the signal line 16. This encapsulation may prevent galvanic action between the dissimilar materials of the signal line 16, the anchor 50 and/or the track rail 40. In this regard, the electrical resistance between these members may not increase over time. Any adhesive may be utilized to encapsulate the signal line 16 so long as the selected adhesive provides adequate bonding strength over a desired temperature range for a given application. For railroad applications, an applicable temperature range may vary between about −40° F. and about +150° F.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed:

1. An anchor for use in connecting a component to track rail, comprising:

a first body member having a first rail contact surface for engaging a first rail surface;

a second body member having a second rail contact surface for engaging a second rail surface and receiving channel for receiving an insertion end of the first body member, wherein said first and second body members are slidably connected for movement between an open position and a closed position;

a spring pawl attached to said insertion end of said first body member, said spring pawl having a flexible body wherein a free end of said flexible body is compressed against an engagement surface of the second body member as said first and second body members slide relative to one another between said open position and said closed position, wherein said flexible body of said spring pawl is disposed at an acute angle relative to said engagement surface and where said acute angle has a first component that is in a direction opposite of a direction of movement of said first and second members between said open position and said closed position wherein said pawl permits movement between said body members in substantially a single direction and wherein said pawl is adapted to engage said engagement surface to fix a relative position of said first and second body members continuously between said open position and said closed position.

2. The anchor of claim 1, wherein said first and second rail contact surfaces are adapted to engage opposing rail surfaces.

3. The anchor of claim 1, wherein said first and second rail contact surfaces are sized to engage outside edges a foot of a track rail, wherein said first and second body members are adapted to extend below the track rail between said outside edges.

4. The anchor of claim 1, wherein said engagement surface comprises a substantially smooth surface.

5. The anchor of claim 4, wherein said pawl has a hardness that is greater than a hardness of said engagement surface.

6. The anchor of claim 1, wherein one of said first and second body members is a receiving body member that receives a portion of the other body member.

7. The anchor of claim 6, wherein said receiving body member includes a channel for receiving said portion of the other body member.

8. The anchor of claim 7, wherein said engagement surface is disposed between edges of said channel.

9. An anchor for use in connecting a component to track rail, comprising:

a first body member including a rail engaging end adapted to engage an outside edge surface of a track rail and a receiving end having a receiving channel;

a second body member including a rail engaging end adapted to engage an outside edge surface of a track rail and an insertion end for insertion within said receiving channel of said first body member, wherein upon initial insertion of said second body member into said receiving channel of said first body member said anchor is in an open position and wherein said second body member can advance relative to said first body member to a fully closed position; and a pawl attached to said insertion end of said second body member, wherein said pawl is a spring member having:

an L-shaped flexible body with a first leg attached to said insertion end of said second body member and a second leg having a free end, wherein the second leg is compressed relative to the first leg upon said insertion end being disposed within said receiving channel and wherein upon said insertion said free end is compressed against and engages an engagement surface along the length said receiving channel to prevent withdrawal of said second body member from said first body member when said insertion end is inserted within said receiving channel and wherein said pawl is adapted to engage said engagement surface to fix a relative position of said first and second body members continuously between said open position and said fully closed position.

10. The anchor of claim 9, wherein said engagement surface comprises a substantially smooth surface.

11. The anchor of claim 10, wherein said pawl has a hardness that is greater than a hardness of said engagement surface.

12. The anchor of claim 9, wherein said receiving end comprises a channel having first and second lateral edges.

13. The anchor of claim 9, wherein said rail engaging ends are at least partially U-shaped to receive a portion of said edge surfaces.

14. The anchor of claim 9 wherein said second leg of said L-shaped body is disposed at an acute angle relative to said engagement surface, where said acute angle has a first component that is in a direction opposite of a direction of movement of said first and second body members between said open position and said fully closed position.

* * * * *

UNITED STATES PATENT AND TRADEMARK OFFICE

CERTIFICATE OF CORRECTION

PATENT NO. : 7,992,797 B2
APPLICATION NO. : 11/862676
DATED : August 9, 2011
INVENTOR(S) : L. Reichle It is certified that error appears in the above-identified patent and that said Letters Patent is hereby corrected as shown below:

On the Title page, Item (57) in the Abstract, delete the second occurrence of the word "toward".
Column 2, line 30, delete "an/or" and insert therefor -- and/or --.

Signed and Sealed this
Thirteenth Day of September, 2011

David J. Kappos

David J. Kappos
*Director of the United States Patent and Trademark Office*